US005350977A

United States Patent [19]

Hamamoto et al.

[11] Patent Number: 5,350,977

[45] Date of Patent: Sep. 27, 1994

[54] LUMINAIRE OF VARIABLE COLOR TEMPERATURE FOR OBTAINING A BLEND COLOR LIGHT OF A DESIRED COLOR TEMPERATURE FROM DIFFERENT EMISSION-COLOR LIGHT SOURCES

[75] Inventors: Katunobu Hamamoto; Shigeo Gotoh, both of Kadoma, Japan

[73] Assignee: Matsushita Electric Works, Ltd., Osaka, Japan

[21] Appl. No.: 73,373

[22] Filed: Jun. 8, 1993

[30] Foreign Application Priority Data

Jun. 15, 1992 [JP] Japan ..... 4-040833

[51] Int. Cl.[5] ..... G05F 1/00

[52] U.S. Cl. ..... 315/291; 315/324; 315/DIG. 4; 315/307; 362/257; 348/655

[58] Field of Search ..... 315/324, 291, 292, 293, 315/307, 316, DIG. 4, 169.1; 362/231, 257; 358/17, 29 C, 93, 240

[56] References Cited

U.S. PATENT DOCUMENTS 4,686,575 8/1987 Shimada et al. ..... 358/240

4,742,387 5/1988 Oshima ..... 358/29

*Primary Examiner*—Benny Lee

*Assistant Examiner*—Haissa Philogene

*Attorney, Agent, or Firm*—Kenyon & Kenyon

[57] ABSTRACT

A luminaire of variable color temperature is arranged for emitting blended color light from luminaire section, with color temperature control signals so transmitted from control section to luminaire-lighting section as to substantially equalize respective differences in reciprocal color temperatures of respective two adjacent stages of the color temperature control signals, to thereby render blended state of emission colors to be variable and a dimming of the blended color light to be realized with the color temperature gradually varied in smooth manner.

14 Claims, 12 Drawing Sheets

LUMINAIRE OF VARIABLE COLOR TEMPERATURE FOR OBTAINING A BLEND COLOR LIGHT OF A DESIRED COLOR TEMPERATURE FROM DIFFERENT EMISSION-COLOR LIGHT SOURCES

BACKGROUND OF THE INVENTION

This invention relates to a luminaire of variable color temperature and, more particularly, to a luminaire made for obtaining a blended color light of any desired color temperature with a plurality of emission colors blended.

DESCRIPTION OF RELATED ART

In recent years, it has been a growing demand that ambient atmosphere can be varied by means of illumination color, and there have been suggested luminaires capable of changing the color temperature of emission as demanded. In the luminaire adapted to a wide range variation of the color temperature while maintaining the quantity of illumination light at a constant level, a plurality of light sources respectively of different color temperatures may be arranged for being lighted separately. With this arrangement, however, it is practically difficult to vary the color temperature gradually smoothly, and generally required use of currently available light sources does not allow the color temperature to be varied through a larger number of stages so that there will arise a problem that the difference in the color temperature between the respective groups has to be made large.

In order to solve this problem, it has been suggested to control the color temperature in the form of a blended color light obtained by means of many light sources of at least three different emission colors. That is, such light sources are so arranged that the ratio of quantity of emitted light of the respective light sources will be controlled to obtain the blended color light of desired color temperature. Assuming here that the light sources of such three different groups of red (R), green (G) and blue (B) series, for example, are employed, the emission colors of the respective light sources are of such chromaticity coordinates as $(x_R, y_R)$, $(x_G, y_G)$ and $(x_B, y_B)$ and that the respective light sources are of such quantity of emitted light as $Y_R$, $Y_G$ and $Y_B$, an emission color $(x_O, y_O)$ of the illumination light and a quantity of light $(Y_O)$ which are of a blended color will be represented by following equations.

$$x_O = \frac{x_R(Y_R/y_R) + x_G(Y_G/y_G) + x_B(Y_B/y_B)}{(Y_R/y_R) + (Y_G/y_G) + (Y_B/y_B)}$$

$$y_O = (Y_R + Y_G + Y_B)/\{(Y_R/y_R) + (Y_G/y_G) + (Y_B/y_B)\}$$

$$Y_O = Y_R + Y_G + Y_B$$

Assuming further that the emission color of the respective light sources is not changed by a variation in the quantity of light, it is then possible to change the emission color of the illumination light obtained in the blended color light by varying the ratio of the quantity of light of the respective light sources, and the quantity of light of the illumination light can be varied when the quantity of light of the respective light sources is changed while maintaining the ratio of their quantity of light. Since the quantity of emitted light $Y_R$, $Y_G$ and $Y_B$ of the respective light sources is determined by the type, configuration, supplied power and the like of the light source, the quantity of emitted light $Y_R$, $Y_G$ and $Y_B$ are varied generally by changing the supplied power. That is, when the ratio of dimming which is the ratio of the quantity of emitted light is controlled by dimming the respective light sources, it will be possible to obtain the blended color light of a desired color temperature.

Provided that the chromaticity coordinates of the respective light sources will be (0.5859, 0.3327) for R, (0.3324, 0.5349) for G and (0.1563, 0.0829) for B, the color temperature can be varied over a wide range from about 2500K to the infinity as shown in a chromaticity coordinates of FIG. 2A.

When the light sources R, G and B of the three different color groups are employed in one for each group and the maximum luminous flux these light sources R, G and B as well as the set luminous flux Y of the illumination light of blended color are in a ratio of 62:100:25:Y, then the dimming ratio of the respective light sources at optional color temperature will be as in a following TABLE I:

TABLE I

| Emission Color | Chromat. Cood. x | Chromat. Cood. y | Col. Temp. (K) | Dimming Ratio (%) R | Dimming Ratio (%) G | Dimming Ratio (%) B |
|---|---|---|---|---|---|---|
| Daylight Color | 0.314 | 0.345 | 6250 | 29 | 69 | 55 |
| White Color | 0.378 | 0.388 | 4200 | 48 | 70 | 27 |
| Warm White Col. | 0.409 | 0.394 | 3450 | 67 | 58 | 19 |
| Bulb Color | 0.440 | 0.403 | 2950 | 72 | 54 | 11 |

In controlling the quantity of emitted light of the respective light sources, on the other hand, it is considered possible in general to carry out the dimming with respect to each of the light sources, but their correspondence to the color temperature is not clear, and it is not possible to have the color temperature varied smoothly gradually. Here, it has been suggested to house the dimming ratio data in a memory section by means of ROM or RAM in correspondence to the color temperature, and to control the ratio of the quantity of emitted light of the respective light sources at the dimming ratio corresponding to the desired color temperature addressed. That is, the data concerning to the dimming ratio are housed in the memory section at multiple stages so that intervals of the respective color temperatures will be equalized, the dimming ratio data of the color temperatures of respectively adjacent ones are sequentially read out, and the color temperature will be varied gradually over a wide range.

In this case, the minimum value of distinguishable difference in the color temperature is referred to as a discriminating threshold of the color temperature and, when this threshold is represented by a micro-reciprocal degree known as Mired (mrd) and obtainable by multiplying $10^6$ times as large as the reciprocal of the color temperature, such discriminating threshold is known to be 5.5 mrd in the human visual system. In other words, such multiple stage recognition at regular intervals of the color temperatures as in the above should render the color temperature at every stage to be distinguishable on lower color temperature side but indistinguishable on higher color temperature side. In an event where the color temperature is to be varied in a range, for example, of 2,500 to 10,000K, such recognition of the dimming ratio data that the color temperature difference between the respective stages is 50K should render the number of the stages to be 151. Corresponding relationship between the [K] indication and the Mired (mrd) indication of the color temperature will be as shown in FIG. 2B, in which the difference in mrd will be 7.8 at about 2,500K, 1.3 at about 6,150K and 0.5 at about 10,000K, as shown in a following TABLE II so long as the color temperature difference between the respective stages is 50K. In the absolute temperature indication, the color temperature discriminating threshold is larger than 200K at about 6,000K, and larger than 500K at about 10,000K. Contrarily, when the color temperature difference between the respective stages is recognized to be 50K, the difference can be discriminated at color temperatures closer to 2,500K, whereas any change in the color temperature is indistinguishable unless the difference is more than 5 stages at temperatures closer to 6,000K or more than 11 stages at temperatures closer to 10,000K.

TABLE II

| Color Temperature (K) | Color Temperature (mrd) | Difference (mrd) |
|---|---|---|
| 2,500 | 400.0 | — |
| 2,550 | 392.2 | 7.8 |
| 2,600 | 384.6 | 7.6 |
| 2,650 | 377.4 | 7.2 |
| 6,000 | 166.7 | 1.4 |
| 6,050 | 165.3 | 1.4 |
| 6,100 | 163.9 | 1.4 |
| 6,150 | 163.6 | 1.3 |
| 9,850 | 101.5 | 0.5 |
| 9,900 | 101.0 | 0.5 |
| 9,950 | 100.5 | 0.5 |
| 10,000 | 100.0 | 0.5 |

When the color temperature difference between the respective stages is so set, therefore, as to correspond to the color temperature discriminating threshold on the lower color temperature side but as to sequentially select at a constant speed the dimming ratio of the respective stages from the lower color temperature side toward the higher color temperature side, the number of the stages which are recognized to be of the same color temperature becomes larger as the color temperature increases to be higher, so that there will arise a problem that the varying speed of the color temperature will be slower as the color temperature becomes higher, causing an operator to feel unnatural. On the higher color temperature side, further, the dimming ratio data are to be recognized with such finely small difference that substantially indistinguishable, so that there will arise a problem that the memory section has to house unnecessary data while rendering the data input operation to be complicated and the memory section itself to become expensive.

When on the other hand the color temperature stages are made to be recognized at invervals of 500K so as to prevent unnecessary data from being housed in the memory section, the number of the stages will be 16 as shown in a following TABLE III, and the data number can be remarkably reduced.

TABLE III

| Color Temp. (K) | Color Temp. (mrd) | Difference (mrd) |
|---|---|---|
| 10,000 | 100.0 | — |
| 9,500 | 105.3 | 5.3 |
| 9,000 | 111.1 | 5.8 |
| 8,500 | 117.6 | 6.5 |
| 8,000 | 125.0 | 7.4 |
| 7,500 | 133.3 | 8.3 |
| 7,000 | 142.9 | 9.6 |
| 6,500 | 153.9 | 11.0 |
| 6,000 | 166.7 | 12.8 |
| 5,500 | 181.8 | 15.1 |

TABLE III-continued

| Color Temp. (K) | Color Temp. (mrd) | Difference (mrd) |
|---|---|---|
| 5,000 | 200.0 | 18.2 |
| 4,500 | 222.2 | 22.2 |
| 4,000 | 250.0 | 27.8 |
| 3,500 | 285.7 | 35.7 |
| 3,000 | 333.3 | 47.6 |
| 2,500 | 400.0 | 66.7 |

In this case, the difference (mrd) between adjacent two stages is close to the color temperature discriminating threshold at color temperatures close to 10,000K but is extraordinarily larger than the discriminating threshold at color temperatures closer to 2,500K, and there still remains a problem that the gradually smooth variation of the color temperature is hardly realizable.

SUMMARY OF THE INVENTION

Accordingly, a primary object of the present invention is to provide a luminaire of variable color temperature which can vary the color temperature gradually enough for causing no unnatural feeling irrespective of the degree of the color temperature even when the variation is made over a considerably wide range.

According to the present invention, this object can be accomplished by means of a luminaire of variable color temperature in which a plurality of light sources of different emission colors are provided for being lighted by a lighting means, the emission colors of the respective light sources are blended for emission of a blended color light from the luminaire, and a control means transmits to the lighting means a color temperature control signal for varying a state in which the emission colors are blended, wherein the signal transmission from the control means to the lighting means is so carried out that respective differences in the reciprocal color temperatures of respective two adjacent stages of the color temperature control signals are substantially equalized.

Other objects and advantages of the present invention shall become clear as following description of the invention advances as detailed with reference to preferred embodiments shown in accompanying drawings.

While the present invention should now be described with reference to the respective embodiments shown in the accompanying drawings, it should be appreciated that the intention is not to limit the invention only to these embodiments shown but rather to include all alterations, modifications and equivalent arrangements possible within the scope of appended claims.

DETAILED DESCRIPTION OF THE PREFERRED EMBODIMENTS

Figure 1:
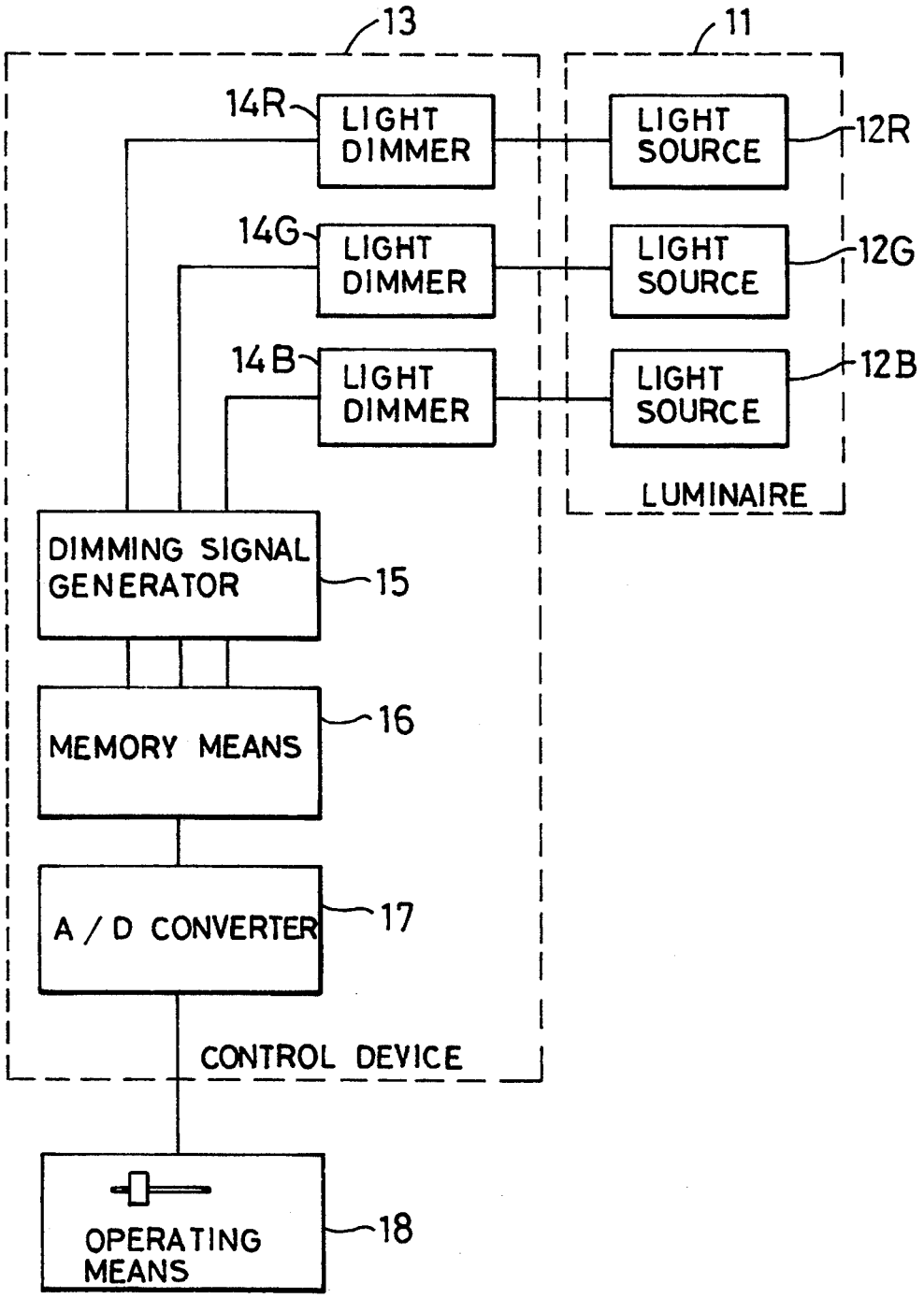
FIG. 1 is a block diagram showing an embodiment of the luminaire of variable color temperature according to the present invention.

Referring to FIG. 1, the luminaire of variable color temperature according to the present invention comprises a luminaire section 11 including a plurality of light sources 12R, 12G and 12B which are fluorescent lamps of three different emission colors such as red series R, green series G and blue series B. For these light sources 12R, 12G and 12B, it will be possible to effectively employ such other members as colored lamps, fluorescent or HID lamps combined with color filters, and so on, so long as they can provide mutually different emitted colors.

The respective light sources 12R, 12G and 12B in the luminaire section 11 are subjected to a dimming by means of a control device 13, which comprises light dimmers 14R, 14G and 14B respectively for dimming every emitted color by controlling supplied power to the respective light sources, and these dimmers 14R, 14G and 14B are so arranged as to control the dimming level of the respective light sources 12R, 12G and 12B by means of dimming signals transmitted by a dimming signal generator 15 which generates the dimming signals on the basis of dimming data housed in a memory means 16 constituted by, for example, ROM. The dimming data are obtained from the color temperature of the illumination light of the luminaire in correspondence to the dimming ratio which is a ratio of the quantities of emitted light of the respective light sources 12R, 12G and 12B, and the dimming ratios of the respective light sources 12R, 12G and 12B are housed in three sets at every address (cell) of the memory means 16. That, the address is made to be in correspondence to the color temperature, and is so set that the dimming data corresponding to the desired color temperature will be provided as outputs by appointing the address corresponding to the desired color temperature. The appointment of the address in the memory means 16 is obtained by converting an analog output of an operating means 18 comprising a fader into a digital signal at an A/D converter 17. For this address appointment at the memory means, an up-down output which can control the input pulse number by means of a switch operation may also be employed.

The dimming data housed in the memory means 16 are set in such manner as follows. In an event where the color temperature is varied in a range from 2,500K to 10,000K, the difference in the color temperature according to the dimming data between the respective adjacent two of the addresses, that is, respective adjacent two stages of the color temperatures, is so set as to be 50K in a lower range of 2,500–4,500K, to be 150K in an intermediate range of 4,500–7,500K, and to be 500K in a higher range of 7,500–10,000K. With such setting, as will be clear from a following TABLE IV, the differences between the respective adjacent two color temperatures as represented by Mired are in a range of 2.5 to 8.3, which are less different from the foregoing human discriminating threshold (=5.5) of the color temperature. That is, the color temperature variation over such a wide range can be discriminated generally at three stages, and any remarkable variation within each stage can be restrained. As a result, there is occurred no such cause for unnatural feeling that varying speed of the color temperature fluctuates or the color temperature is abruptly varied, when the color temperature is varied sequentially through the respective stages of the color temperatures between the lower color temperature side and the higher color temperature side, and it is made possible to vary the color temperature gradually without any unnatural feeling. In addition, the number of stages involved here is made to be 66, and it is made possible to remarkably reduce the required number of the dimming data sets in contrast to the foregoing case where the color temperatures are set at regular intervals over the whole range in which the color temperature can be controlled, the intervals being set to be 50K for allowing the variation to be gradual. That is, it is enabled to reduce the memory capacity to realize cost reduction, and to render input work of the dimming data to be easier. While the intervals of the color temperatures at every adjacent two stages are set to be of two color temperatures at 4,500K and 7,500K, it is also possible to set the same at, for example, 4,000K, 6,000K, 8,000K and so on. The color temperature differences between the respective stages are also not required to be limited to 50K, 150K and 500K.

TABLE IV

| Color Temp. (K) | Width (K) | Color Temp. (mrd) | Difference (mrd) |
|---|---|---|---|
| 2,500 | | 400.0 | |
| 2,550 | 50 | 392.2 | 7.8 |
| 2,600 | 50 | 284.6 | 7.6 |
| 4,400 | 50 | 227.3 | 2.6 |
| 4,450 | 50 | 224.7 | 2.6 |
| 4,500 | 50 | 222.2 | 2.5 |
| 4,650 | 150 | 215.1 | 7.1 |
| 4,800 | 150 | 208.3 | 6.8 |
| 7,200 | 150 | 138.9 | 2.9 |
| 7,350 | 150 | 136.1 | 2.8 |
| 7,500 | 150 | 133.3 | 2.8 |
| 8,000 | 500 | 125.0 | 8.3 |
| 8,500 | 500 | 117.7 | 7.3 |
| 9,000 | 500 | 111.1 | 6.6 |
| 9,500 | 500 | 105.3 | 5.8 |
| 10,000 | 500 | 100.0 | 5.3 |

In another working aspect of the present invention, the dimming data for the respective stages are so set that the color temperature difference presented in Mired will be 6 mrd, as will be given in a following TABLE V. Since in this case the color temperature discrimating threshold of the human visual system is 5.5 mrd, the dimming data are set at intervals close to the color temperature discriminating threshold. With respect to the color temperature controlling range of 2,500 to 10,000K, here, 51 stages of the dimming data may only be required to be set. That is, the number of stages can be more reduced than in the case of the foregoing TABLE IV, and the capacity of the memory means 16 can be also made smaller. Further, while the color temperature difference between the respective two adjacent stages is made 6 mrd, it is not required to be limited to this value so long as the set value is effective enough for rendering the color temperature variation recognized to be gradual.

TABLE V

| Col. Temp. | | | | | | | | | | | | |
|---|---|---|---|---|---|---|---|---|---|---|---|---|
| (mrd) | 400 | 394 | 388 | 382 | 262 | 256 | 250 | 244 | 118 | 112 | 106 | 100 |
| (K) | 2,500 | 2,538 | 2,577 | 2,618 | 3,817 | 3,906 | 4,000 | 4,098 | 8,475 | 8,929 | 9,434 | 10,000 |
| Width (K) | | 38 | 39 | 41 | 86 | 89 | 94 | 98 | 410 | 454 | 505 | 566 |

In the working aspect along the line of the above TABLE V, all other constituents are the same as those in the foregoing embodiment along the line of TABLE IV. Further, the arrangement of TABLE V is just an example, and it is possible to make wider in respect of part of the width (mrd). Further, while in the arrangement of TABLE V the minimum difference of the interval of the color temperature is shown to be 6 mrd, it should be appreciated that the same can be set less than 6 mrd, for example, 2 mrd.

In still another working aspect of the present invention, as shown in a following TABLE VI, the color temperature difference between the respective two adjacent stages is set to be regular intervals of 40K for the color temperatures of 2,500–5,000K, and to be intervals of 6 mrd for the range of 5,000–10,000K. Noticing in this case that the setting of the regular intervals in the color temperature on the lower color temperature side causes no unnatural feeling, the setting is so made only on the higher color temperature side that the reciprocals of the color temperatures will be at regular intervals. In this case, too, the variation in the color temperature for about four stages can be discriminated, so that there occurs substantially no unnatural feeling and the color temperature can be gradually varied. In the working aspect along the line of this TABLE VI, further, the variable range of the colar temperature is to be 2,520–5,615K, whereas the difference of 3.25 mrd for 2,520K and 2,500K and 4.0 mrd for 9,615K and 10,000K will render the result to be substantially equal to that in the case where the color temperature is varied from 2,500K to 10,000K. Here, the dimming data are set in 79 stages.

TABLE VI

| Color Temperature | | Width: | |
|---|---|---|---|
| (K | (mrd) | (K) | (mrd) |
| 2,520 | 396.8 | | |
| 2,560 | 390.6 | 40 | 6.2 |
| 2,600 | 384.6 | 40 | 6.0 |
| 2,640 | 378.8 | 40 | 5.8 |
| 4,920 | 203.3 | 40 | 1.6 |
| 4,960 | 201.6 | 40 | 1.7 |
| 5,000 | 200.0 | 40 | 1.6 |
| 5,155 | 194.0 | 155 | 6.0 |
| 5,319 | 188.0 | 164 | 6.0 |
| 8,197 | 122.0 | 384 | 6.0 |
| 8,621 | 116.0 | 424 | 6.0 |
| 9,091 | 110.0 | 470 | 6.0 |
| 9,615 | 100.0 | 524 | 6.0 |

In the above working aspect along the line of TABLE VI, other arrangements are the same as those in the foregoing embodiment along the line of TABLE IV. Further, the color temperature intervals on the low color temperature side and the intervals of the reciprocals of the color temperature on the higher color temperature side are properly settable in a range of causing no unnatural feeling.

Here, it should be assumed that the emission colors of the respective light sources 12R, 12G and 12B are of such chromaticity coordinates as 12R(0.5537, 0.3300), 12G(0.2946, 0.5503) and 12B(0.1694, 0.1052), and of such color temperatures that variable in a range of 3,000K to 30,000K, and that a dimming illumination is carried out with the luminaire shown in FIG. 1. At this time, a single light is employed for each of the light sources 12R, 12G and 12B, and a ratio of the maximum luminous flux of the respective light sources 12R, 12G and 12B to the set luminous flux Y of the illumination light of a blended color is assumed to be 62:100:25:Y, then the dimming ratio of the respective light sources 12R, 12G and 12B at some optional color temperatures will be as shown in a following TABLE VII:

TABLE VII

| Set Col. Temp. | Chromat. Cood. | | Dim. Ratio of Lt. Src. | | | Set Lum. Flx. |
|---|---|---|---|---|---|---|
| (K) | x | y | 12R | 12G | 12B | Y |
| 3,000 | 0.4356 | 0.4030 | 97.5 | 67.86 | 6.76 | 130 |
| 5,000 | 0.3450 | 0.3600 | 62.23 | 81.25 | 40.56 | 130 |
| 10,000 | 0.2820 | 0.2940 | 43.61 | 80.47 | 89.96 | 130 |

As seen in the above TABLE VII, the dimming level of the light source 12B in the case of a high color temperature is higher than that of the light source 12R but the dimming level of the light source 12R in the case of a low color temperature is higher than that of the light source 12B. Within the variable color temperature range of 3,000K to 30,000K, the light source 12G is at the dimming level of more than 50%, and the dimming level 6.76% of the light source 12B at 3,000K is the lowest value.

Figure 2A:
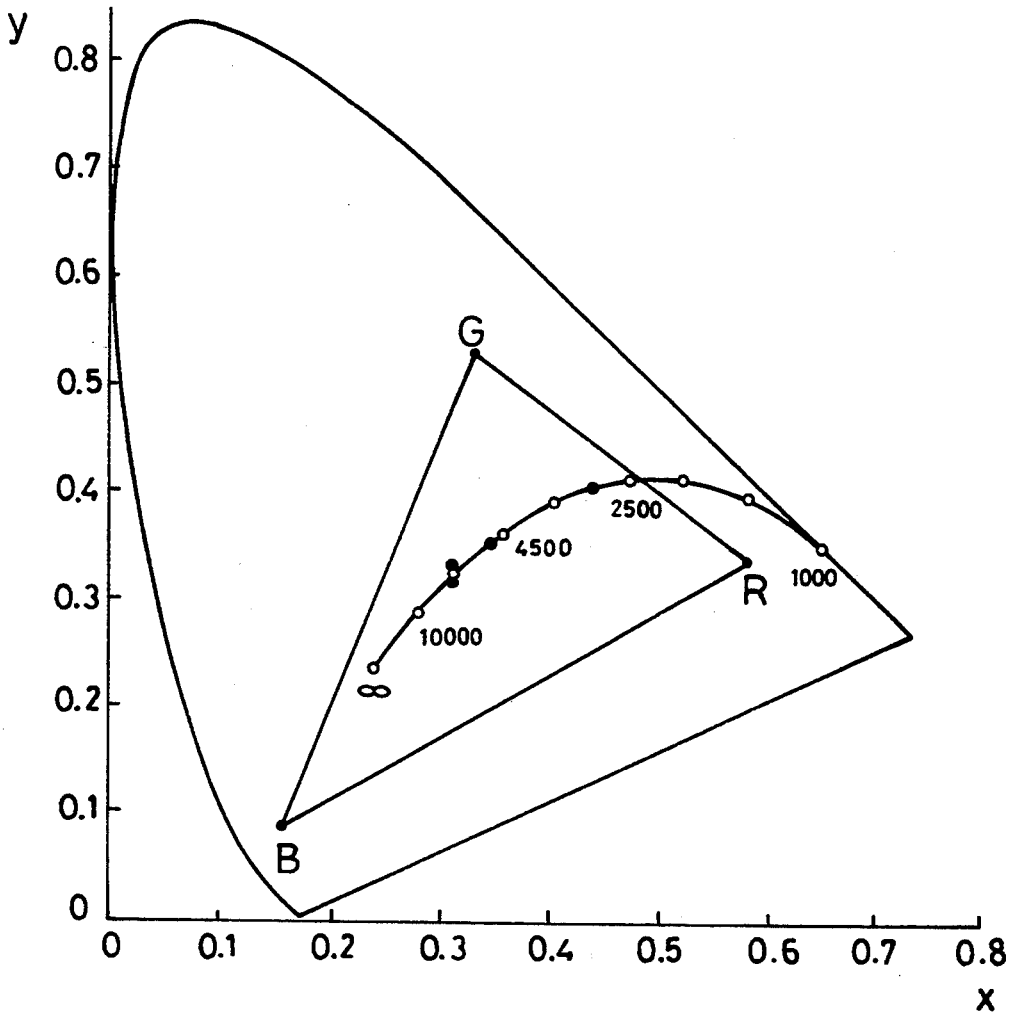
FIG. 2A is the chromaticity coordinates relative to the luminaire of FIG. 1.
Figure 2B:
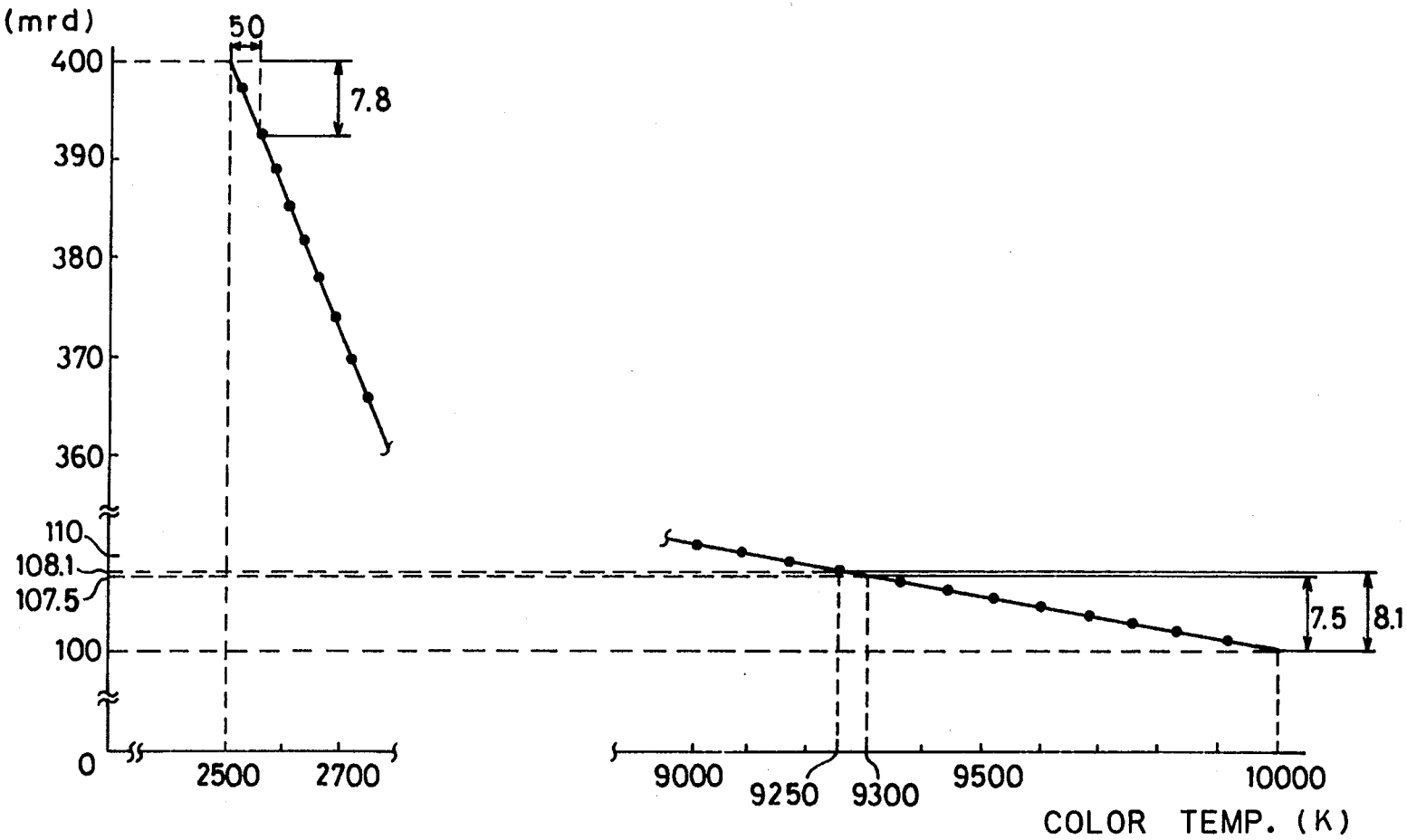
FIG. 2B is a graph showing the relationship between the color temperatures denoted by [K] and [mrd]
Figure 2C:
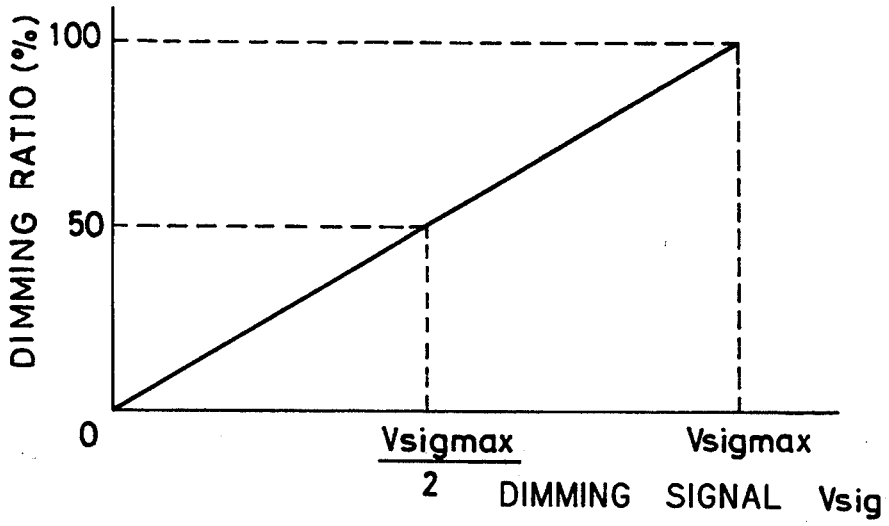
FIG. 2C is a graph showing the relationship between the dimming signal to the dimmer and the dimming ratio.
Figure 2D:
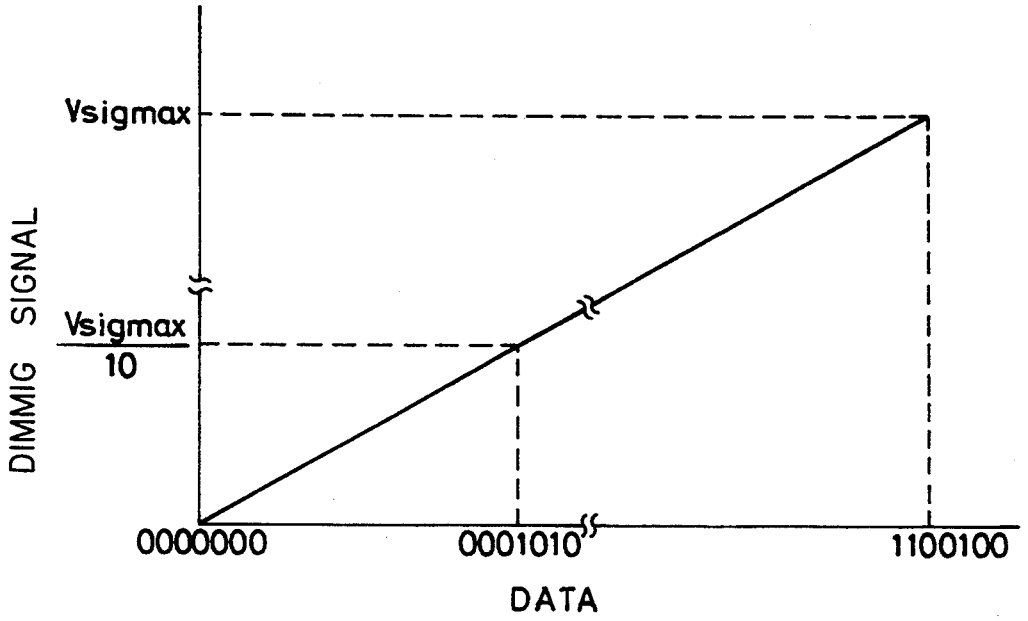
FIG. 2D is a graph showing the relationship between the quantity of light data determining the dimming ratio and the dimming signals.

Further, the relationship between the dimming signals $V_{sig}$ provided to the dimmers 14R, 14G and 14B and their dimming ratio is made as shown in FIG. 2C, and the quantity of light data are so set that a 100 stage dimming (1, 2, 3 . . . 98, 99 & 100%) will be carried out with the variation width of a 1% dimming ratio. In this case, the respective quantity of light data for determining the dimming ratio of the respective light sources 12R, 12G and 12B may be of 7 bit data (0000001=1,1100100=100,1111111=128). The relationship of such data to the dimming signals $V_{sig}$ is shown in FIG. 2D. In respect of numerical values below the decimal point, it becomes necessary to deal with them in such that, here, the values less than 0.50 are made 0.00 and those above 0.51 are made 1.00. With such treatment, the dimming ratio of the respective light sources 12R, 12G and 12B at the time of the set color temperatures as shown in the foregoing TABLE VII as well as the illumination light in the case when the emission colors are blended in practice will be as shown in a following TABLE VIII, from which it will be appreciated that the blended color of the illumination light is caused to involve a deviation from the set values, due to the setting to be 1% of the variation width of the dimming ratio of the quantity of light data.

TABLE VIII

| Set Col. Temp. | Set Chromat. Coord. | | Set Lt. Flx. | Dim Rt. (%) data | | | Prac. Chromat. Coord. | | Prac. Lt. Flx. |
|---|---|---|---|---|---|---|---|---|---|
| (K) | x | y | Y | R | G | B | x | y | Y' |
| 3,000 | 0.4356 | 0.4030 | 130 | 97 | 68 | 7 | 0.4346 | 0.4028 | 129.89 |
| 5,000 | 0.3450 | 0.3600 | 130 | 62 | 81 | 41 | 0.3444 | 0.3591 | 129.69 |
| 10,000 | 0.2820 | 0.2940 | 130 | 44 | 80 | 90 | 0.2824 | 0.2937 | 129.78 |

On the other hand, the dimming is carried out at a constant color temperature set to be 3,000K and with a dimming ratio varied at every 1% step. Then, the variation width of the dimming ratio of the respective light sources 12R, 12G and 12B as calculated will be 0.98% for 12R, 0.68% for 12G and 0.07% for 12B. In respect of the light source 12B, here, the width is calculatively 0.07% but is required to be 1% because of the 1% step, and the dimming ratio setting has to become coarce. Further, when the dimming is made with the color temperature kept the same, a deviation in the emission color becomes remarkable as the luminous flux is made lower. This is caused by the dimming carried out at the 1% variation width in practice, notwithstanding the calculative 0.07% variation width for the dimming ratio of the light source 12B.

For the purpose of restraining this deviation in the emission color, it may be a feasible measure to divide the variation width of the dimming ratio more finely, by increasing the number of the dimming stages or steps to, for example, 200 stages so as to render the variation width to be 0.5. With this measure, the emission color deviation may be made less than in the case of the 100 step dimming, whereas the quantity of light data to be stored in the memory section for the data will have to be made 8 bit data. When on the other hand the foregoing 0.07% width as the minimum dimming width is made as a reference, it is then necessary to increase the varying step to be 1,429 steps, and the quantity of light data are required to be of 11 bit data.

The minimum variation width of the dimming ratio made smaller thus renders the data number to be increased, causing a problem to arise in necessitating a larger capacity memory means.

According to another feature of the present invention, however, the varying width of the dimming ratio for the respective light sources itself is varied in accordance with the dimming level, whereby any deviation of the emission color temperature of the luminaire from the set value can be minimized without increasing required data number of the quantity of light to be preliminarily stored.

Figure 3:
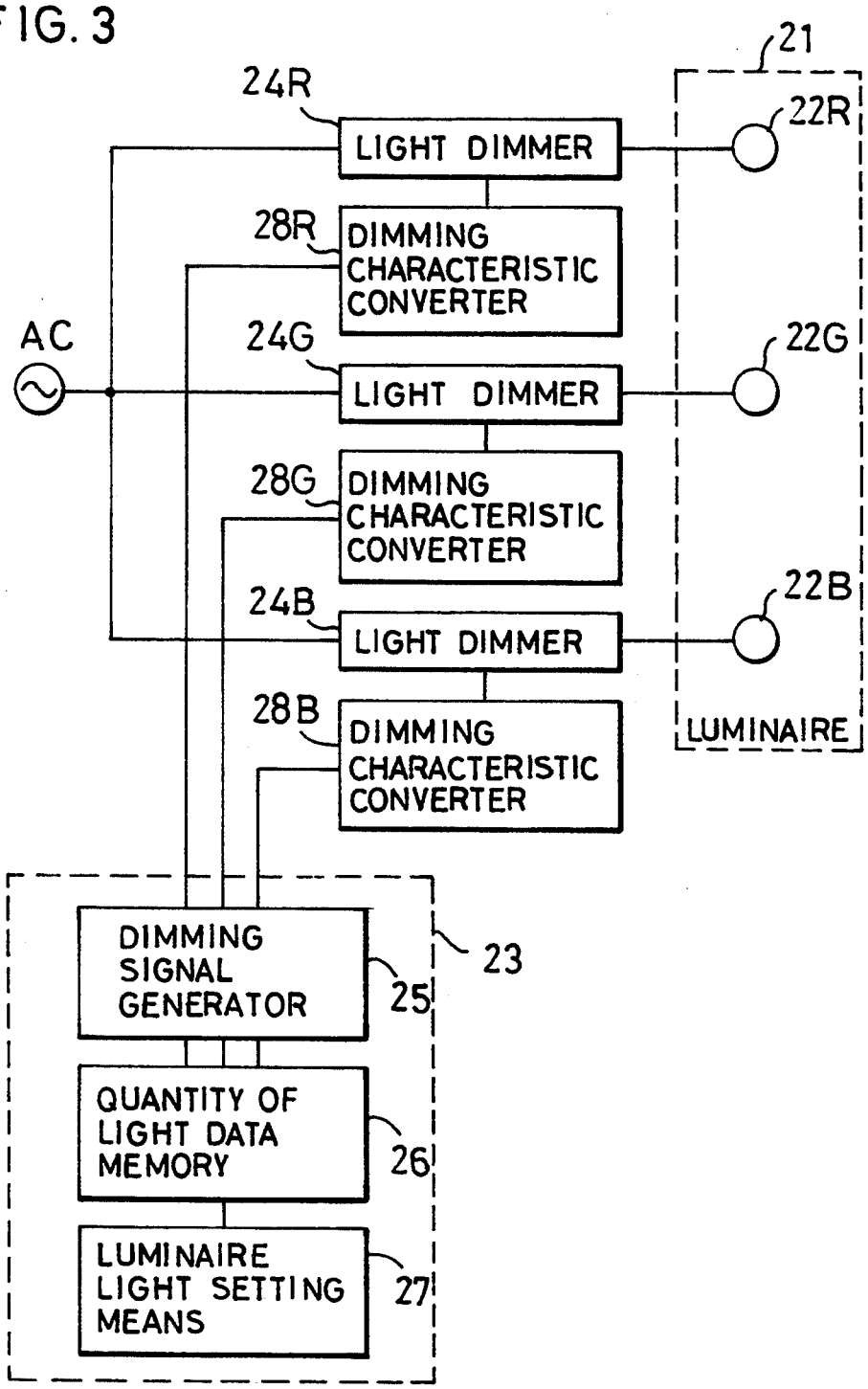
FIG. 3 is a block diagram showing another embodiment of the luminaire of variable color temperature according to the present invention.
Figure 4:
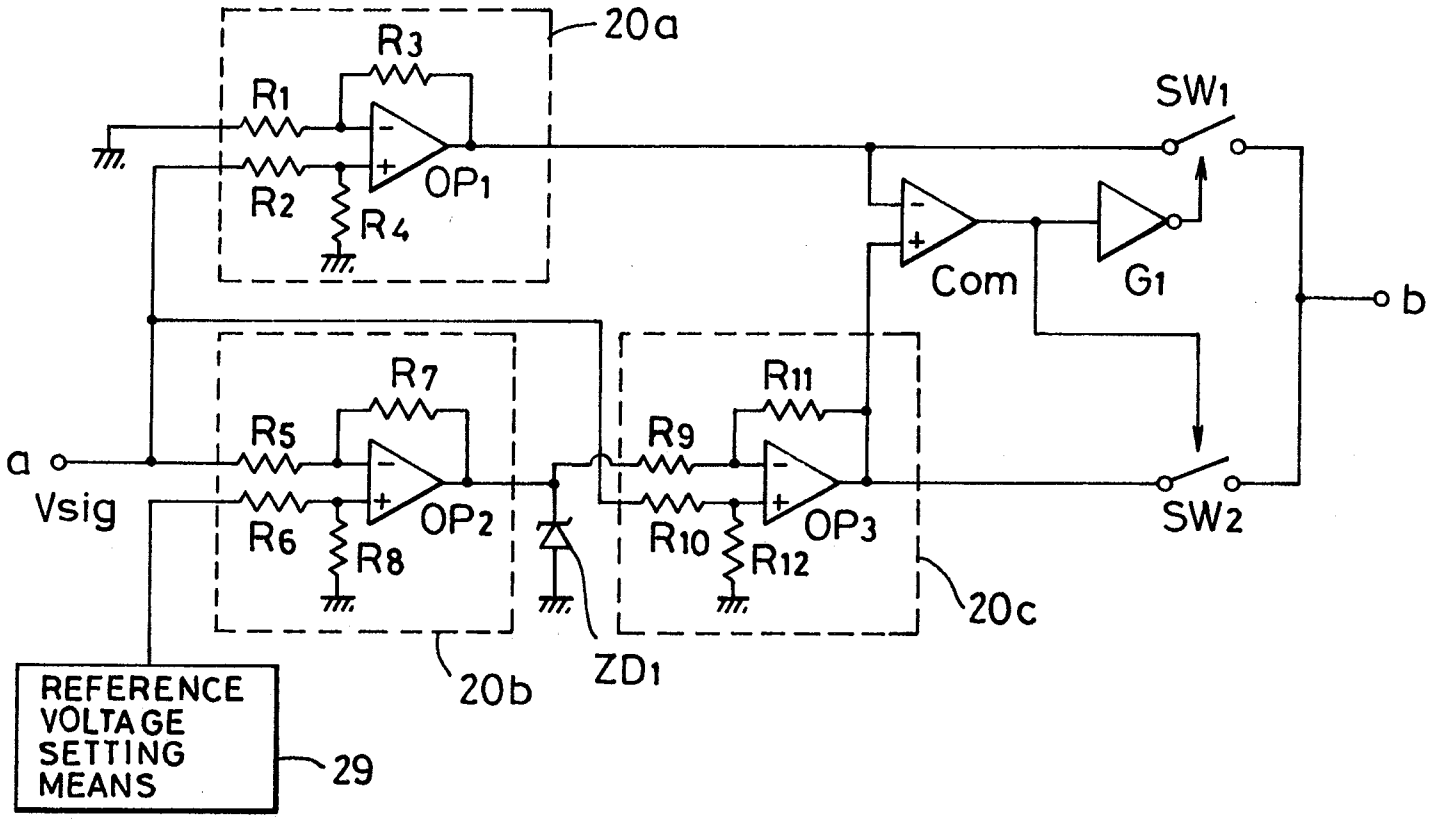
FIG. 4 is a circuit diagram showing a dimming characteristic converter employed in the luminaire of FIG. 3.

Referring to FIG. 3, there is shown another embodiment of the luminaire of variable color temperature according to the present invention, in which in particular the control section 23 provides the dimming signals on the colors R, G and B first to dimming characteristic converters 28R, 28G and 28B disposed respectively in parallel to the dimmers 24R, 24G and 24B and then, after execution of a predetermined characteristic convertion in these converters, to the dimmers 24R, 24G and 24B. More specifically, the dimming signals $V_{sig}$ provided out of the dimming signal generator 25 into the dimming characteristic converters 28R, 28G and 28B are subjected to such operation as referred to in the followings and executed in these converters which are respectively constituted in the same manner and are described with reference to FIG. 4 showing only one dimming characteristics converter 28B.

The dimming signal $V_{sig}$ is input through a terminal a of the converter to be provided concurrently to a differential amplifier **20*a* comprising an operational amplifier $OP_1$ and resistors $R_1$–$R_4$ and to a further differential amplifier 20*b* comprising an operational amplifier $OP_2$ and resistors $R_5$–$R_8$, while the differential amplifier 20*a* also receives zero V and the other differential amplifier 20*b* receives a reference voltage signal $V_{ref}$ set in a reference voltage setting means 29. Outputs of these differential amplifiers 20*a* and 20*b*** are determined by their set values and, when it is assumed that $R_1=R_2=R_5=R_6=R$, $R_3=R_4=\alpha R$ and $R_7=R_8=\beta R$, respective outputs $V_{OP1}$ and $V_{OP2}$ of the operational amplifiers $OP_1$ and $OP_2$ are presented in following formulas:

$$V_{OP1}=(\alpha R/R)\cdot(V_{sig}-0)=\alpha V_{sig}$$

$$V_{op2}=(\beta R/R)\cdot(V_{ref}-V_{sig})=\beta(V_{ref}-V_{sig})$$

Figure 5:
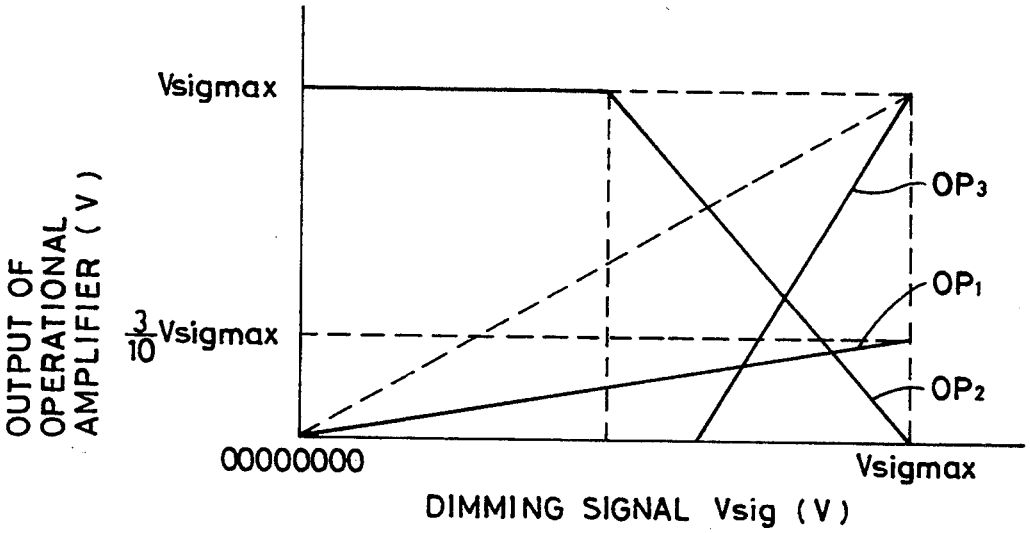
FIGS. 5 to 8 are diagrams for explaining the operation of the dimming characteristic converter shown in FIG. 4.

When it is assumed here that $\alpha<1$, $\beta>1$ and $V_{ref}=-V_{sig.max}$, the output characteristics of the operational amplifiers $OP_1$ and $OP_2$ with respect to the dimming signal $V_{sig}$ will be as shown in FIG. 5. That is, in FIG. 5, it is made that $\alpha=3/10$ and $\beta=2$, so that the output $V_{OP2}$ of the operational amplifier $OP_2$ is so set by a Zener diode $ZD_1$ as not to exceed $V_{sig.max}$.

Further, the output of the operational amplifier $OP_2$ is input to another differential amplifier **20*c* comprising an operational amplifier $OP_3$ and resistors $R_9$–$R_{12}$ while the other input terminal of this differential amplifier 20*c* receives the dimming signal $V_{sig}$. The resistors in this differential amplifier 20*c*** are made to be $R_9=R_{10}=R_{11}=R_{12}$ and the output of the operational amplifier $OP_3$ is $V_{OP3}=V_{sig}=V_{OP2}$, which output as well as the output of the operational amplifier $OP_1$ are provided respectively into a comparator Com. An output of this comparator Com is provided through a switching element $SW_2$ and an inverter gate $G_1$ to a switching element $SW_1$ so that, when $V_{OP1}>V_{OP3}$, the switching element $SW_2$ is turned ON while the switching element $SW_1$ is turned OFF and, when $V_{OP1}\leqq V_{OP3}$, the switching element $SW_1$ is turned ON while the switching element $SW_2$ is turned OFF.

Figure 6:
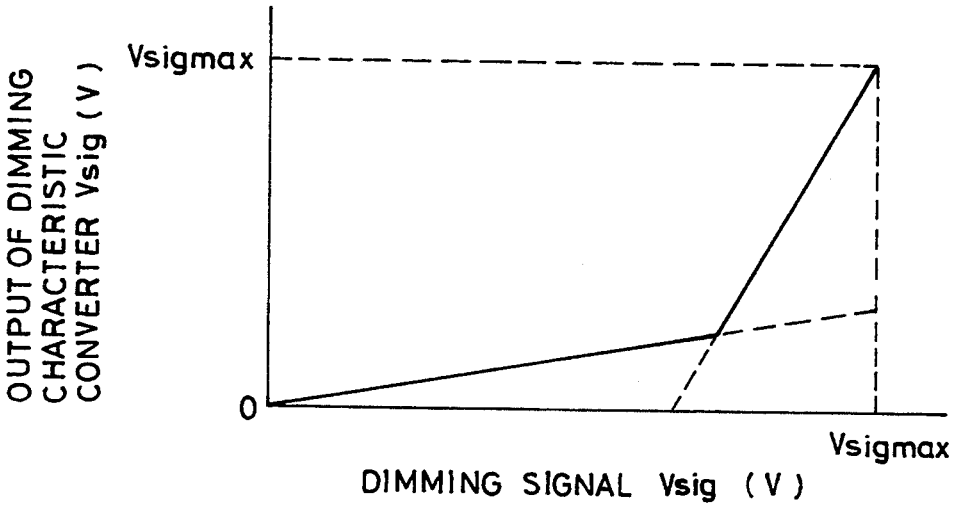

Consequently, a signal provided out of an output terminal b of the dimming characteristic converter 28B will be as shown in FIG. 6, which dimming signal $V_{sig}$40 is provided to the dimmer 24B. The same signals are also provided from other dimming characteristic converter 28R and 28G to their corresponding dimmers 24R and 24G so that, when the dimming level of the respective light sources 22R, 22G and 22B is low, the variation width of the dimming ratio will be made smaller or, when the dimming level is high, the variation width of the dimming ratio will be made larger, and the dimming data are prepared on the basis of such dimming characteristics.

Here, the minimum variation width of the dimming ratio is required to be obtained with the minimum variation width of the respective light sources 22R, 22G and 22B used as the reference, and to be set taking into account the maximum luminous flux ratio of the respective light sources 22R, 22G and 22B as well as their number, so as to be, for example, about 0.07%.

According to the luminaire of variable color temperature as shown in FIGS. 3 and 4, the minimum variation width of the dimming ratio in particular is excellently set, and the quantity of light of the respective light sources 22R, 22G and 22B can be thereby made substantially at the value computed, without increasing the capacity of the data of the quantity of light. That is, even when a deviation is caused to be involved in the color temperature of the illumination light, the deviation can be restrained to be in a range indistinguishable to the human.

Figure 7:
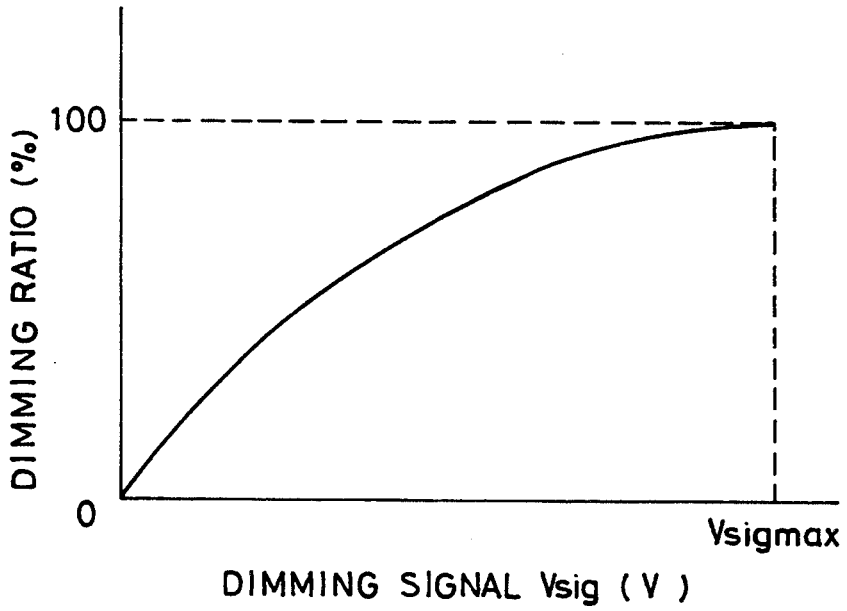
Figure 8:
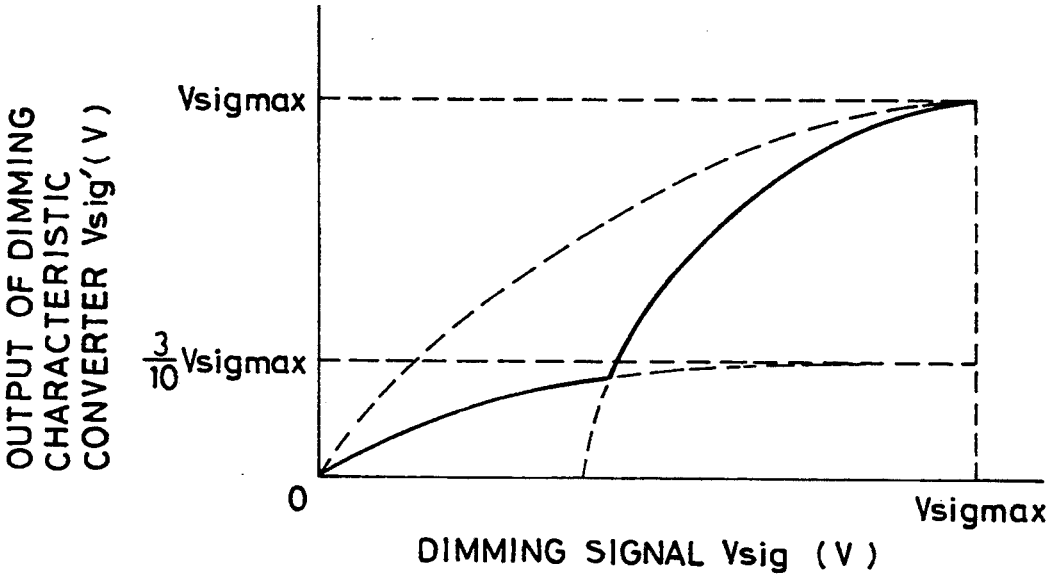

While in the foregoing description it has been premised that the dimming signals are of a DC voltages, they may be replaced by duty signals, phase control signals or the like, and, when the duty signals are employed, it may suffice the purpose to execute such signal conversion that provides as outputs DC voltages proportional to the duty ratio. Further, while it has been also premised in the foregoing description that the dimming characteristics are linear, even the dimming characteristics which are non-linear as shown in FIG. 7 will result in a transmission of such output signals $V_{sig}'$ as shown in FIG. 8 from the respective dimming characteristic converters.

In the embodiment of FIGS. 3 and 4, other constituents and functions are the same as those in the embodiment of FIG. 1, and the same constituents as those in FIG. 1 are denoted in FIGS. 3 and 4 by the same reference numbers as those used in FIG. 1 but with an addition of "10".

Figure 9:
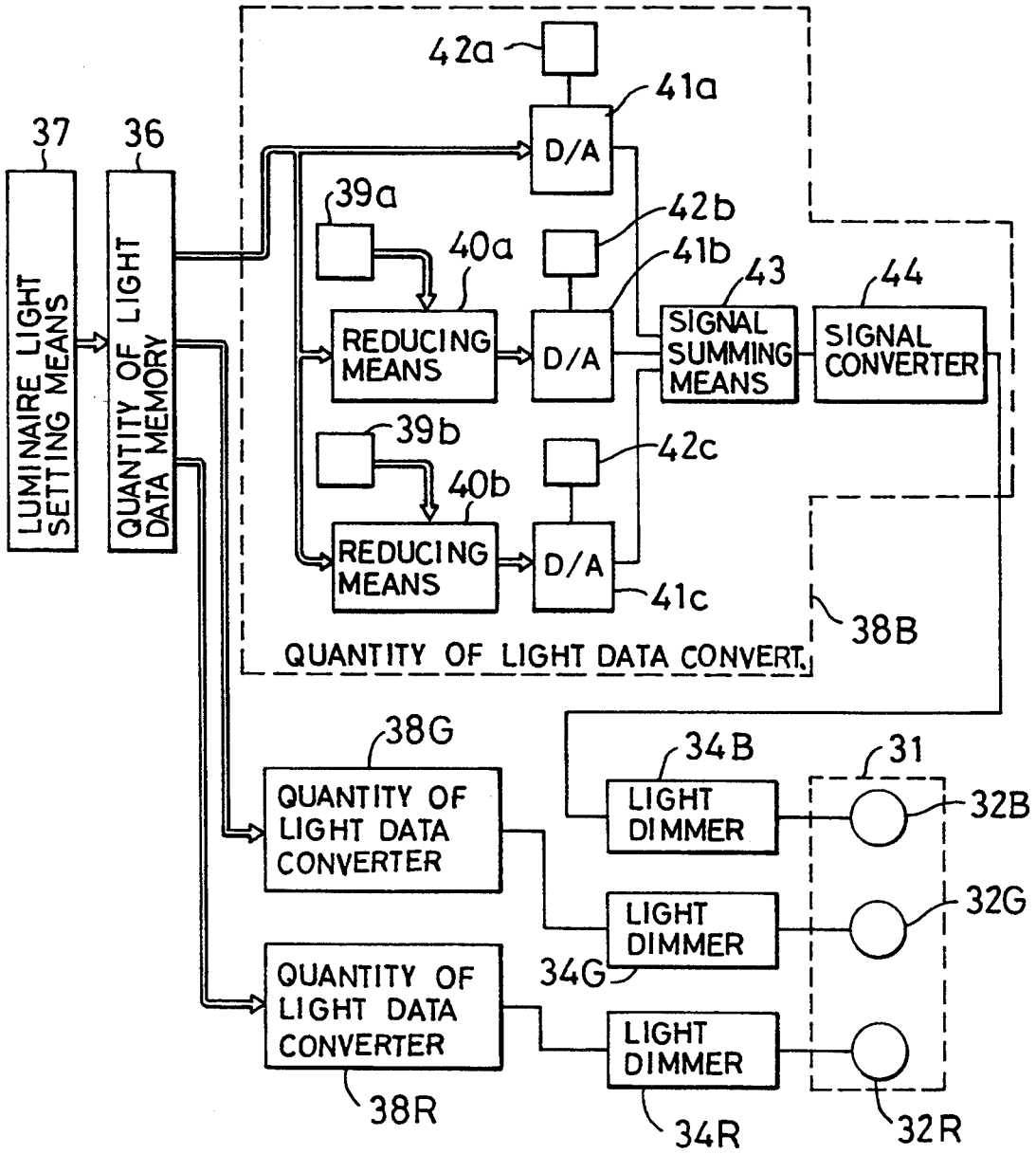
FIG. 9 is a block diagram showing still another embodiment of the luminaire of variable color temperature according to the present invention.

Referring now to FIG. 9, there is shown an arrangement for restraining the deviation of the color temperature from the set value to be the minimum, similarly to the case of FIGS. 3 and 4. The present instance is also featured in the dimming characteristics converters 38R, 38G and 38B which are mutually of the same construction, and following description will be made with reference to only one dimming characteristic converter 38B.

This dimming characteristic converter 38B comprises a pair of reference data setting means **39*a* and 39*b*, a pair of reduction means 40*a* and 40*b*, three D/A converters 41*a*–41*c*, three reference voltage setting means 42*a*–42*c*, a signal summing means 43 and a signal converter 44. Here, as the quantity of light data corresponding to the desired color temperature are provided out of a quantity of light data memory 36, the data for determining the dimming ratio of the corresponding light source 32B in the luminaire section 31 are provided to the dimming characteristic converter 38B. The input dimming signal to the corresponding dimmer 34B at this time is made $V_{sig}$ and the quantity of light data is made to be of 8 bits. Accordingly, the number of dimming stages for the light source 32B** is made 256, and the variation width of the dimming ratio is made to be 100/256=0.39%, so as to be extremely larger than, for example, the foregoing minimum variation width 0.07% of the dimming ratio.

In this case, the quantity of light data provided to the dimming characteristic converter 38B are given to the D/A converter **41*a* and to both of the reduction means 40*a* and 40*b*, in respective which 8 bits data preliminarily set at the reference data setting means 39*a* and 39*b* are being provided. Here, it is assumed that the quantity of light data in one reference data setting means 39*a* are (00110011) while the quantity of light data in the other reference data setting means 39*b* are (11100110). At the reduction means 40*a* and 40*b*, such reduction as (the quantity of light data) minus (the reference data) is executed so that, when (the quantity of light data)≦(the reference data), an output (00000000) will be provided. That is, for the one reduction means 40*a*, the output will be (00000000) for the quantity of light data from (00000000) to (00110011) and, for the other reduction means 40*b***, the output will be (00000000) for the quantity of light data from (00000000) to (11100110).

Figure 10:
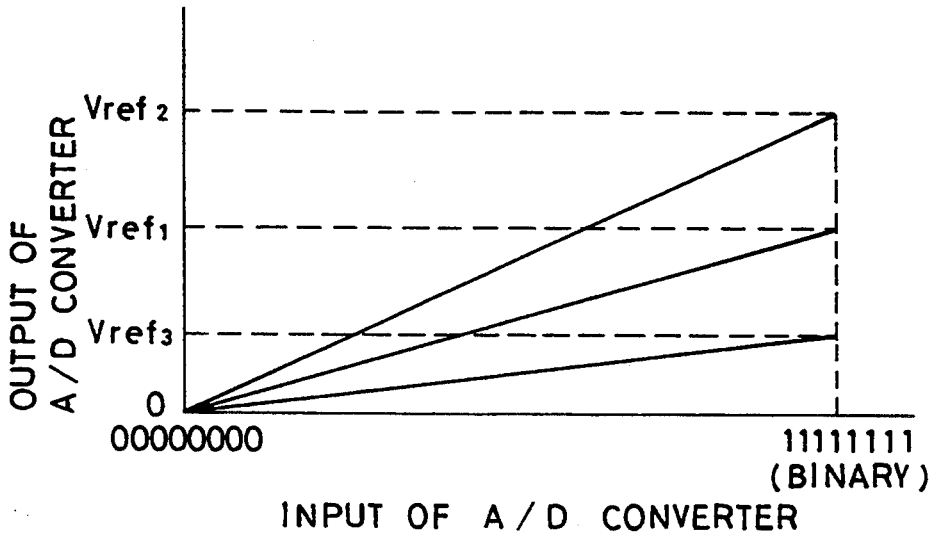
FIGS. 10 to 14 are diagrams for explaining the operation of the luminaire in the embodiment of FIG. 9.

The output data of the reduction means **40*a* and 40*b* are given respectively to the D/A converters 41*b* and 41*c*, while these D/A converters 41*b* and 41*c* as well as 41*a* are receiving respectively the reference voltage preliminarily set at the reference voltage setting means 42*b* and 42*c* as well as 42*a*. Assuming here that the reference voltages set at these reference voltage setting means 42*a*–42*c* are $V_{ref1}$, $V_{ref2}$ and $V_{ref3}$, the outputs with respect to the input 8-bit data to the D/A converters 41*a*–41*c* will be as shown in FIG. 10. Here, the D/A converter 41*a* receives as its input the quantity of light data provided out of the quantity of light data memory 36, whereas the D/A converters 41*b* and 41*c* are receiving as their input the data as the balance of the reduction of the reference data from the quantity of light data. That is, the D/A converter 41*b* receives the data obtained by deducting (00110011) from the quantity of light data, and the D/A converter 41*c*** receives the data obtained by deducting (11100110) from the quantity of light data.

Figure 11:
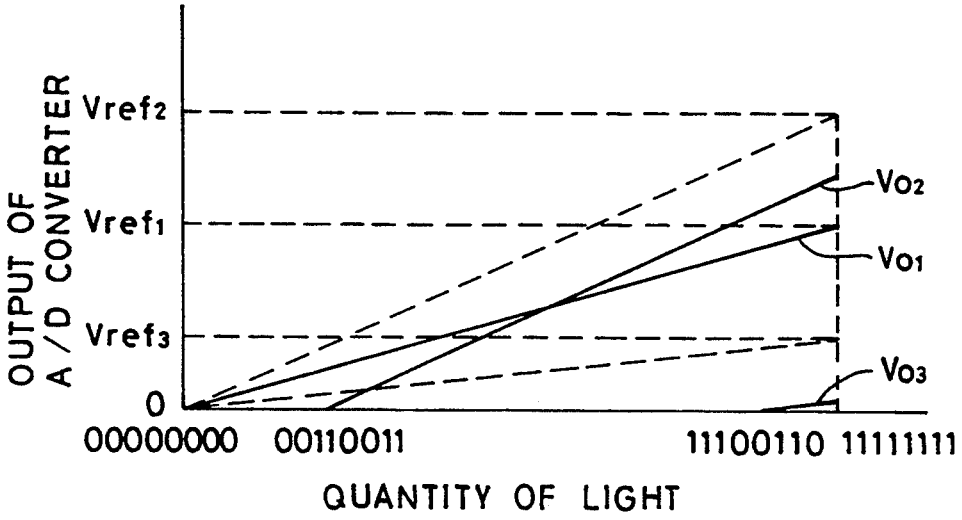

Accordingly, in the event where the quantity of light data are (00100100), the input data to the D/A converters **41*a*–41*c* will be (00100100), (00000000) and (00000000); when the quantity of light data is (00111000), the input data to the D/A converters will be (00111000), (00000101) and (00000000); and, when the quantity of light data are (11110000), the input data to the D/A converters will be (11110000), (10111101) and (00001010). Therefore, when the respective outputs of the D/A converters 41*a*–41*c* are represented by $V_{01}$, $V_{02}$ and $V_{03}$, their relationship to the quantity of light data will be as shown in FIG. 11**.

Figure 12:
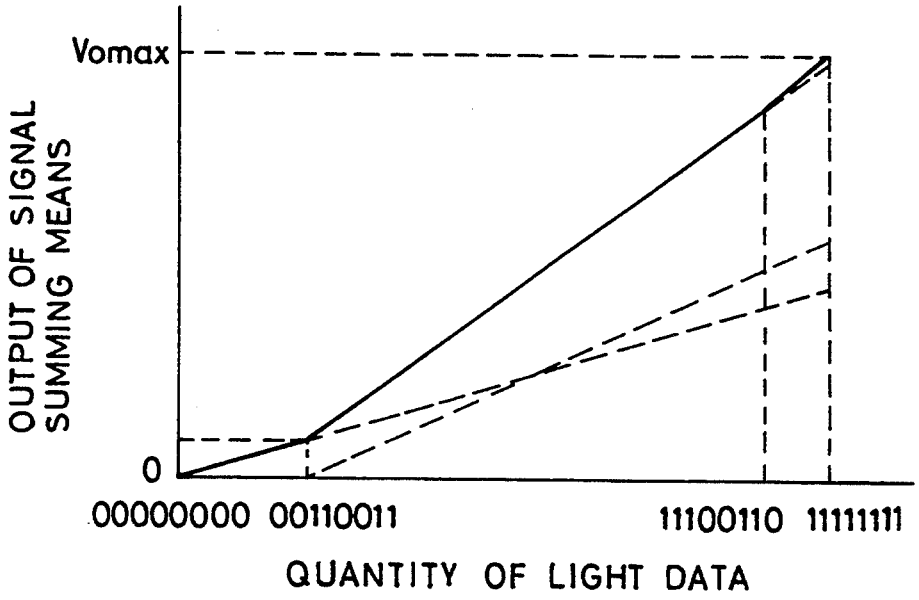
Figure 13:
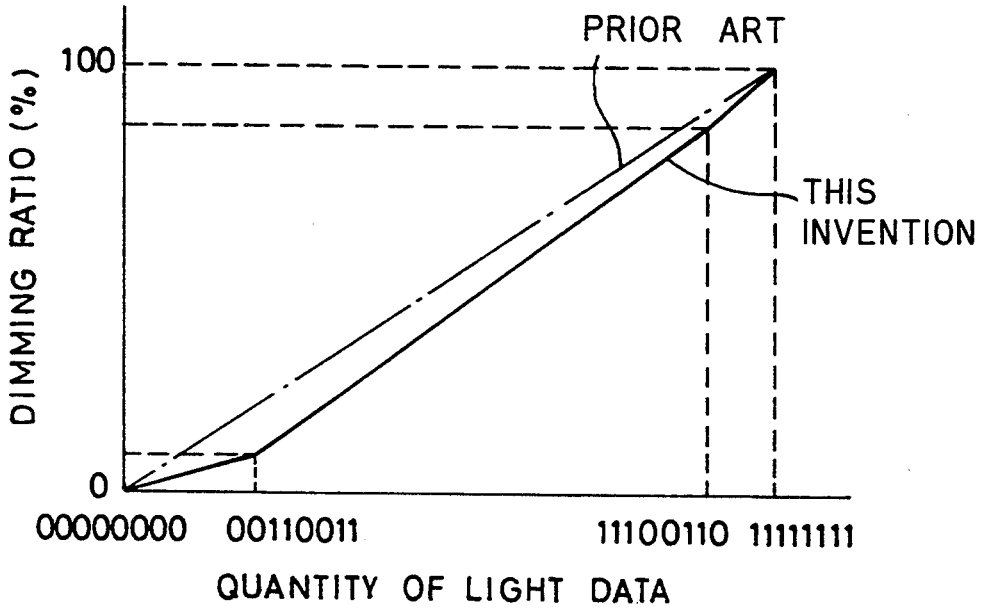

The respective outputs $V_{01}$, $V_{02}$ and $V_{03}$ are summed at the signal summing means 43 so that a summed output will be $V_{01}+V_{02}+V_{03}$, and such output as shown in FIG. 12 can be obtained with respect to the quantity of light data. This output signal $V_O$ is converted at the signal converter 44 into the dimming signal suitable for being used at the dimmer 34B. The dimming characteristics with respect to the quantity of light data accompanying the switching of the variation width of the dimming ratio will be as shown in FIG. 13.

In the present instance, the same operation as in the above is carried out with respect to the further light sources 32R and 32G through the dimming characteristic converters 38R and 38G, and the optimum dimming characteristics are obtained. That is, the variation width of the dimming ratio with respect to the quantity of light data is so set as to be small when the dimming level is low but to be large when the dimming level is high, and the luminaire is made to be smoothly gradual in the color temperature variation.

In the embodiment of FIG. 9, other constituents and their functions are the same as those in the embodiment of FIG. 1 or 3, and the same constituents as those in the embodiment of FIG. 1 or 3 are denoted by the same reference numbers as those used in FIG. 1 or 3 but with "10" or "20" added.

Figure 14:
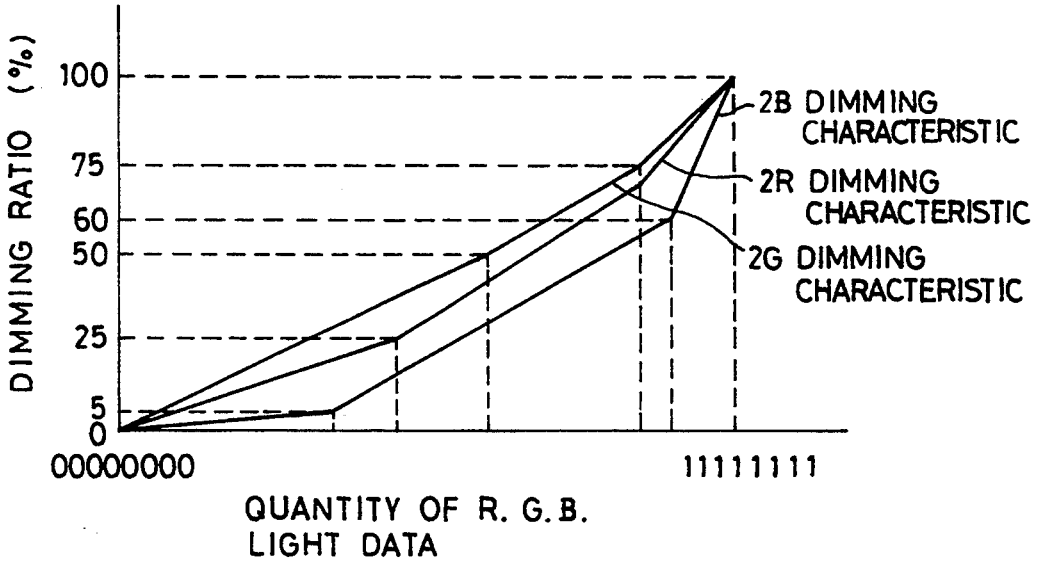
Figure 15:
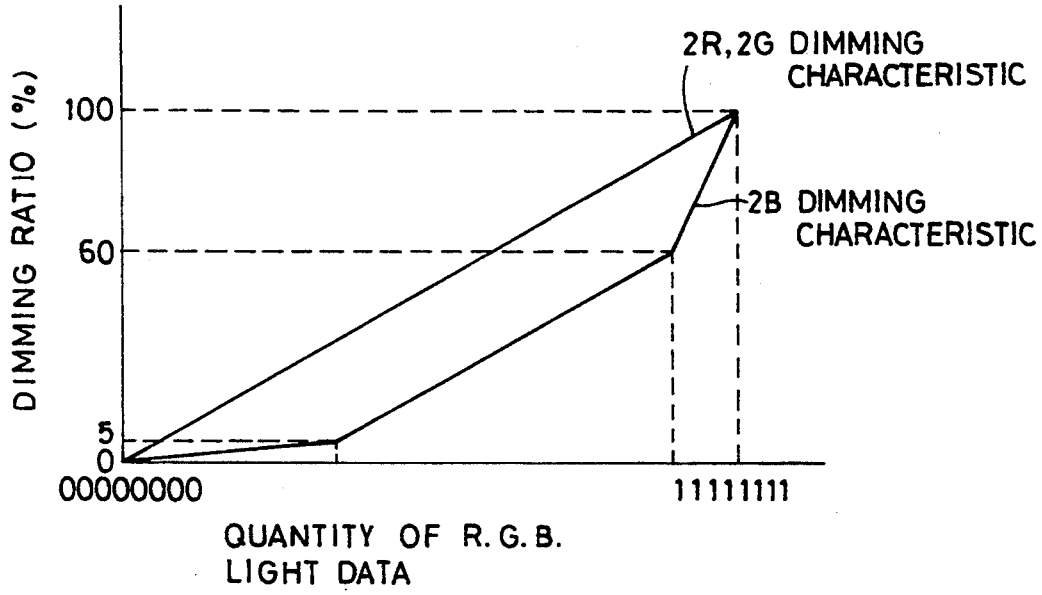

In the present invention, various design modifications can be made. For example, while the light sources have been referred to as having red, green and blue colors, it is possible to employ the light sources of such other colors as yellow, white and so on. Further, the light sources can be of a variety of consuming powers, and a light source of a low consuming power may also be used. While in the foregoing description of the respective embodiments the variation width of the dimming ratio has been referred to as involving three groups just as an example, the same may of course be made four groups or more. As shown in FIG. 14, further, the dimming characteristics of the respective light sources may be determined by changing the variation width of the respective dimming ratio, taking the emission color of the respective light sources into account. Further as shown in FIG. 15, the arrangement may be so modified as to change the variation width of the dimming ratio only with respect to, for example, the blue color of the light sources.

What is claimed is:

1. A luminaire of variable color temperature for obtaining a blended color light of a desired color temperature from different emission-color light sources, comprising:

a luminaire section including a plurality of light sources of mutually different and respectively predetermined emission colors, and means for lighting said plurality of light sources respectively in said predetermined emission colors, for emitting a blended color light with said emission colors of said light sources blended; and a control section for transmitting to said lighting means of said luminaire section color-temperature control signals for varying a state in which the emission colors are blended to vary said blended color light from one of a plurality of blended color lights to another, said color-temperature control signals representing respectively a color temperature of each light source desired for obtaining said predetermined emission color of each light source, and respective differences in values of the color temperatures when represented by the reciprocal color temperatures of respective two adjacent stages of said control signals in a desired variation range of the color temperature being substantially equalized at any level of said variation range.

2. The luminaire according to claim 1, wherein said control section comprises a memory means in which said differences in the reciprocal color temperature of respective said two adjacent stages are set to be close to a predetermined color temperature descriminating threshold.

3. The liminaire according to claim 1, wherein said control section comprises a memory means in which said differences in the reciprocal color temperatures of respective said two adjacent stages are set in a range of substantially 1.0–10.0 mrd.

4. The luminaire according to claim 1, wherein said control section comprises means for dimming respective said light sources at a dimming ratio variable at a variation width changeable in different groups.

5. The luminaire according to claim 1, wherein said control section comprises a dimming characteristic converting means for dimming respective said light sources at a dimming ratio variable with a variation width changeable to be narrower when the light sources are dimmed at a low level and to be wider when the light sources are dimmed at a high level.

6. The luminaire according to claim 5, wherein said dimming characteristic converting means executes an analog signal processing.

7. The luminaire according to claim 5, wherein said dimming characteristic converting means executes a digital signal processing.

8. The luminaire according to claim 1, wherein said light sources are fluorescent lamps.

9. The luminaire according to claim 1, wherein said light sources have said emission colors of more than three colors containing at least red, green and blue.

10. The luminaire according to claim 1, wherein said light sources have said emission colors of more than three colors and positioning in a zone surrounded by desired chromaticity coordiates of at least red, green and blue on a color temperature graph.

11. The luminaire according to claim 1, wherein said light sources have said emission colors of more than three colors, and said control section further comprises means for dimming said light sources, the light sources of at least one of said three emission colors being dimmed at a dimming ratio with variable difference width.

12. The luminaire according to claim 1, wherein said light sources have said emission colors of three colors including red, green and blue, and said control section further comprises means for dimming said light sources, the light sources of said blue emission color only being dimmed at a dimming ratio at variable difference width.

13. The luminaire according to claim 2, wherein said memory means sets said color temperature differences to be about 50K in a range of color temperatures of about 2,500–4,500K, to be about 150K in a range of about 4,500–7,000K and to be about 500K in a range of about 7,500–10,000K.

14. The luminaire according to claim 2, wherein said memory means sets a color temperature difference in accordance with dimming data set in adjacent ones of addresses housed in the memory means to be about 40K in a color temperature range of about 2,500–5,000K and to be about 6 mrd in said range of about 2,500–5,000K.

* * * * *